US009555551B2

(12) United States Patent
Campbell et al.

(10) Patent No.: US 9,555,551 B2
(45) Date of Patent: Jan. 31, 2017

(54) ROTARY SHAVING UNIT

(71) Applicant: KONINKLIJKE PHILIPS N.V., Eindhoven (NL)

(72) Inventors: Stuart Robbie Campbell, Groningen (NL); Jan Dirk Van Den Berge, Paterswolde (NL); Johan Pragt, De Wilgen (NL); Friso Terpstra, Sneek (NL); Albert Maas De Lange, Gorredijk (NL); Wouter Van Kempen, Sappemeer (NL); Robert Alexander Van Eibergen Santhagens, De Wilgen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 218 days.

(21) Appl. No.: 14/371,071

(22) PCT Filed: Dec. 24, 2012

(86) PCT No.: PCT/IB2012/057683

§ 371 (c)(1),
(2) Date: Jul. 8, 2014

(87) PCT Pub. No.: WO2013/104965

PCT Pub. Date: Jul. 18, 2013

(65) Prior Publication Data

US 2015/0040403 A1 Feb. 12, 2015

Related U.S. Application Data

(60) Provisional application No. 61/584,858, filed on Jan. 10, 2012.

(51) Int. Cl.
*B26B 19/14* (2006.01)
*B26B 19/38* (2006.01)

(52) U.S. Cl.
CPC ..... *B26B 19/14* (2013.01); *B26B 19/141* (2013.01); *B26B 19/143* (2013.01); *B26B 19/3846* (2013.01)

(58) Field of Classification Search
CPC ..... B26B 19/14; B26B 19/141; B26B 19/143; B26B 19/3846
See application file for complete search history.

(56) References Cited

U.S. PATENT DOCUMENTS 2,365,368 A 12/1944 Verschuyl
2,824,367 A * 2/1958 McWilliams ..... B26B 19/14 30/34.2

(Continued)

FOREIGN PATENT DOCUMENTS

CA 2536424 A1 8/2006
CA 2536426 A1 8/2006

(Continued)

*Primary Examiner* — Hwei C Payer

(57) ABSTRACT

A shaving unit includes a cap having an annular shaving track defining an axis. The shaving track is provided with hair entry apertures which have a V-shaped forward edge with a point directed in a cutting direction. Further, a rotary cutter has a plurality of cutter blades, where the rotary cutter is configured to rotate about the axis such that the cutter blades follow the shaving track in the cutting direction to cut hairs protruding through the hair entry apertures. The cutter blades have a V-shaped cutting edge, where a point of the V-shaped cutting edge is directed opposite to the direction of rotation of the rotary cutter.

19 Claims, 8 Drawing Sheets

(56) References Cited

U.S. PATENT DOCUMENTS

| | | | | | |
|---|---|---|---|---|---|
| 3,019,525 | A | | 2/1962 | Brueker | |
| 3,116,551 | A | * | 1/1964 | Anton | B26B 19/141 30/346.51 |
| 3,119,180 | A | | 1/1964 | Brueker | |
| 3,261,091 | A | * | 7/1966 | Van Den Driest | B26B 19/141 30/346.57 |
| 4,281,453 | A | * | 8/1981 | Bakker | B26B 19/141 30/346.51 |
| 4,283,849 | A | * | 8/1981 | Engelhardt | B26B 19/42 30/43.6 |
| 4,635,360 | A | * | 1/1987 | Tanahashi | B26B 19/14 30/34.2 |
| 4,882,840 | A | * | 11/1989 | Tietjens | B26B 19/143 30/346.51 |
| 5,408,749 | A | * | 4/1995 | Momose | B26B 19/141 30/347 |
| 6,199,282 | B1 | * | 3/2001 | Uchiyama | B26B 19/141 30/346.51 |
| 6,868,611 | B2 | * | 3/2005 | Geertsma | B26B 19/143 30/346.51 |
| 7,665,214 | B2 | * | 2/2010 | Okabe | B26B 19/141 30/43.4 |
| 8,037,613 | B2 | * | 10/2011 | Everett, Jr. | B26B 19/14 30/346.51 |
| 8,434,233 | B2 | * | 5/2013 | Okabe | B26B 19/141 30/346.51 |
| 2009/0025228 | A1 | * | 1/2009 | Minkes | B26B 19/145 30/43.6 |
| 2010/0175258 | A1 | * | 7/2010 | Kleine Doepke | B26B 19/384 30/34.1 |
| 2015/0040403 | A1 | * | 2/2015 | Campbell | B26B 19/141 30/43.6 |

FOREIGN PATENT DOCUMENTS

| | | | |
|---|---|---|---|
| CN | 201427317 | Y | 3/2010 |
| DE | 1856031 | U | 8/1962 |
| EP | 1566247 | A1 | 8/2005 |
| GB | 2008471 | A | 6/1979 |
| JP | 592784 | A | 1/1984 |
| WO | WO0189775 | A1 | 11/2001 |
| WO | 2008152590 | A1 | 12/2008 |
| WO | 2010113068 | A1 | 10/2010 |

* cited by examiner

ROTARY SHAVING UNIT

CROSS-REFERENCE TO PRIOR APPLICATIONS

This application is the U.S. National Phase application under 35 U.S.C. §371 of International Application No. PCT/IB2012/057683 filed on Dec. 24, 2012, which claims the benefit of U.S. Provisional Patent Application 61/584858, filed Jan. 10, 2012. These applications are hereby incorporated by reference herein.

FIELD OF THE INVENTION

The present invention relates to shavers and more particularly to rotary shaving units comprising an external cutting element or cap which co-operates with a rotating internal cutting element or cutter. The invention also relates to an improved geometry cap and cutter for such devices.

BACKGROUND OF THE INVENTION

Electric shavers are well known in which a number of rotary shaving units are combined into a shaving head. A particularly common design uses three shaving units in an equilateral triangular configuration. Each shaving unit comprises an external cutting element or cap and an internal cutting member or cutter. The cap is provided with a series of hair catching apertures or slots arranged substantially radially in one or more annular regions referred to as shaving tracks. The cap has an outer surface for engagement with the skin of a user and an inner surface which, in the shaving track region, is engaged by the cutter. The slots form cutting surfaces at the inner surface of the cap. The cutter carries cutter blades which terminate in cutting edges. Hairs entering the slots are cut or sheared between the cutting surfaces and the cutting edges. An example of such a shaving unit is disclosed in WO-2008/152590.

In designing a shaving unit, a primary consideration is to achieve as close a shave as possible. Nevertheless, it is well established within the shaving field that reducing the level of irritation suffered by a user during shaving is also desirable. A significant contributor to such irritation is skin damage caused by severing the top layers of skin by the cutting edges. The damage occurs due to the viscous properties of skin which cause the skin to bulge upwards (commonly referred to as skin doming) within the hair catching apertures or slots and enter the shaving area, where it may be cut or nipped between the cutter blades and the cutting surfaces.

It would therefore be desirable to alleviate this issue by providing a shaving unit with specific external and internal cutting member geometry to gently remove protruding skin from the shaving area and reduce the level of skin damage caused. It would also be desirable to still further reduce the external cutting element thickness in the cutting region in order to improve the closeness of the shave. It would also be desirable to provide larger hair catching apertures to improve hair catching efficiency.

SUMMARY OF THE INVENTION

According to the invention there is provided a shaving unit comprising a rotary cutter having a plurality of cutter blades, each having a cutting edge, the rotary cutter being arranged to rotate about an axis in a direction of movement; a cap having an annular shaving track arranged concentrically about the axis for cooperation with the cutter blades, the shaving track being provided with hair-entry apertures or slots that, seen in the direction of movement, have a front edge and a rear edge; wherein the front edges of the hair-entry apertures and the cutting edges of the cutter blades each have a V-shaped portion comprising a central base part interconnecting two associated leg parts mutually enclosing an angle; wherein, in the direction of movement, each central base part of the V-shaped portions of the front edges is arranged in front of its associated leg parts, so that the V-shaped portions of the front edges point in the direction of movement; and wherein, in the direction of movement, each central base part of the V-shaped portions of the cutting edges is arranged behind its associated leg parts, so that the V-shaped portions of the cutting edges point in a direction opposite to the direction of movement. As a result of this geometry, a shearing angle defined between the cutting edge of the cutter blades and the front edge of the hair-entry apertures varies from a large angle in a tip region of the cutter blade to a small angle in a central region of the shaving track.

Without wishing to be bound by theory, it appears that the large shearing angle in the tip region causes hair and skin to be deflected sideways in a radial direction. Due to the difference in resilience and behaviour between skin and hair, the hair is deflected to a greater extent and is manipulated by interaction with the front edge of the hair entry aperture and the cutting edge towards the central base part. The skin on the other hand is pulled tight but unable to stretch into this region to the same extent. In the central region, the hair is cut off as the cutting edge passes the front edge. Damage to the skin is avoided due to the fact that it is pulled back by tension out of the central region and out of the way of the cutter as will be disclosed in further detail below.

As a result of the improved geometry, wider apertures may be used, leading to improved hair entry without a corresponding risk of skin doming and skin damage. Additionally or alternatively, a thinner cap thickness may be used than in conventional shaving units without skin doming causing skin damage.

Although in this context, reference is given to a V-shaped cutting edge and front edge of the hair entry apertures, it will be understood that these terms represent a generalization of the shapes of these elements. The point of the V-shaped cutting edge will in general be radiused. Furthermore, the cutting edge may in fact be V-shaped, U-shaped, bowed, swoosh-shaped, tick-shaped or any such shape in which the central base part effectively lags behind the leg parts. The same applies to the V-shaped front edges of the hair entry apertures, which may also have any of the above mentioned forms.

In one embodiments, the rear edges of the hair-entry apertures also each have a V-shaped portion comprising a central base part, which interconnects two associated leg parts of said V-shaped portion mutually enclosing an angle and which, in the direction of movement, is arranged in front of the associated leg parts, so that the V-shaped portions of the rear edges point in the direction of movement. The apertures may in fact be in the form of slots of substantially constant width although this need not necessarily be the case. It may for instance be desirable that the apertures are relatively wider at their extremities to allow entry of hair and relatively narrow in the central region whereby it is more difficult for skin to enter and be cut or damaged.

Preferably, the central base parts of the V-shaped portions of said front edges and the central base parts of the V-shaped portions of the cutting edges are arranged at a single radial distance from the axis. In that case, a shearing angle will be zero at the point at which the points align. It is of course also possible that the respective points are offset from each other whereby no single area with zero shearing angle will be present. Furthermore, although all the points of the V-shaped cutting edges will generally be mutually aligned along a circle, this need not necessarily be the case. The same applies to the central base parts of the front edges which may be mutually aligned along the shaving track.

In a further preferred embodiment, the angle enclosed by the two leg parts of the V-shaped portions of the front edges is larger than the angle enclosed by the two leg parts of the V-shaped portions of the cutting edges. The angle of the leg parts of the front edges may thus be relatively obtuse, while the leg parts of the cutting edges may form a smaller angle and may even form an acute angle. The shallow angle of the front edges enhances the tendency of the skin and hair to be drawn in a radial direction whereby the resilient character of the skin causes it to retract from the central region where cutting takes place. Additionally, the strength of the lamellae forming the cap is greater for relatively obtuse angled slots. In order to achieve a shearing angle of around 90° the angle defined by the leg parts of the cutting edge may thus be relatively smaller.

In a still further embodiment, the hair entry apertures may extend radially beyond the cutter blades to a circumferential side surface of the shaving track. Such a lateral extension of the apertures facilitates hair entry during movement of the shaving unit over the skin. The apertures will generally extend to an outer circumferential side surface of the cap but may also extend to an inner circumferential side surface of the track. The side surfaces of the track may also form a side surface of the cap.

The invention also relates to a rotary cutter for a shaving unit comprising a support member having an axis of rotation, said support member carrying a plurality of upstanding legs each terminating in a cutter blade having a cutting edge, each cutter blade having a direction of movement during rotation of the rotary cutter about the axis of rotation, wherein the cutting edges each have a V-shaped portion comprising a central base part interconnecting two associated leg parts mutually enclosing an angle, and wherein, in the direction of movement, each central base part of the V-shaped portions is arranged behind its associated leg parts, so that the V-shaped portions of the cutting edges point in a direction opposite to the direction of movement. Such a cutter blade may be used as described above whereby in the tip regions the cutting edge is angled with respect to a direction of movement, causing a radially directed force to be applied to any objects in its path. The radially directed force is directed towards the central base part. In this region, the cutting edge is angled substantially in a radial direction whereby a force exerted by the cutting edge upon an object in its path will be circumferential. The V-shaped cutting edge may be radiused at its point and be shaped as described above. For the sake of clarity, it is noted in this context that reference to the forward face of the cutter blade being partially concave is intended to refer to a concavity in the plane perpendicular to the axis of rotation. In directions normal to this plane, the forward face need not be concave and may even be straight.

In a preferred embodiment, the front surface of the cutter blade is angled with respect to the direction of movement by a cutter angle or wedge angle. The cutting edge thus forms a leading edge as the cutter rotates. The cutter angle is preferably between 35° and 70° to the direction of movement, preferably between 40° and 50°. Nevertheless, in certain embodiments, a cutter angle of 90° may be provided. This may be advantageous for certain manufacturing procedures such as wire spark erosion. A large cutter angle is also generally more friendly to the skin and less likely to cause damage.

In another advantageous embodiment, the upper face of the cutter blade is convex and shaped for engagement with a domed or toroidal inner surface of a shaving track. In this context it will be understood that the upper surface may be part barrel or cylinder shaped, with an axis of the cylinder aligned with the direction of movement. Such domed or toroidal shaving tracks have been found advantageous in providing improved doming control of the skin surface and may provide a still better shave.

Preferably, the leg parts of the V-shaped cutting edge define an angle of between 60° and 120°. In this context it is understood that the legs are those parts of the cutting edge that extend from the central base part to the respective tips. In the case that the cutting edge does not define an actual V, this angle is the difference between the local angle of the cutting edge at the respective tips. By angling each tip region at a relatively acute angle with respect to the direction of movement, a greater sideways force may be imparted on objects such as skin and hairs being engaged by the blade.

In one embodiment, the cutting edge is substantially symmetrical about the central base part. In that case, similar forces may be exerted on objects entering the shaving path from either tip region. It may however be understood that a relatively smaller angle at the outer tip than at the inner tip may sometimes be desirable, since more objects will enter the shaving path from the outer circumference.

In a preferred form of the cutter, the support element, the upstanding legs and the cutter blades are all integrally formed from metal sheet material. As a consequence of such construction, all of the members will have substantially the same overall thickness and the cutter blade will also have a rear face that corresponds substantially with the forward face. The upper face will thus also be generally V-shaped. Such a cutter may thus be formed by stamping, punching or cutting from metal sheet and subsequently cold formed to the desired configuration. Thereafter the upper surface can be machined (electrical discharge machining) to the desired shape to match the inner surface of the shaving track and thereby form the cutting edge.

In a further embodiment of the invention, the rotary cutter is provided with a retraction mechanism. The retraction mechanism comprises at least one hair retraction element associated with a respective one of the cutter blades and arranged ahead of the associated cutter blade in the direction of movement and nested within the V-shaped portion of the associated cutter blade. The hair retraction element comprises a retraction edge and a V-shaped cross-section extending perpendicular to the axis of rotation, wherein said V-shaped cross-section has a central base part interconnecting two associated leg parts mutually enclosing an angle. The hair retraction element may be resiliently mounted on a support member of the rotary cutter. Preferably, each of the cutter blades of the rotary cutter is associated with a separate hair retraction element. In operation a hair will first be snagged by the retraction edge of the hair refraction element and, as a result of the continuing rotation of the rotary cutter, will be pulled out of the skin over a certain pulling distance before the hair will be finally cut by the cutting edge of the associated cutter blade. As a result, the hair will be cut at a location that was closer to the skin surface or even below the skin surface before the pulling action of the hair retraction element. After being cut the hair will again be refracted back into the skin over a distance similar to the pulling distance, so that a high degree of skin smoothness will result from the cutting action. The pulling distance is mainly determined by a retraction distance present between the retraction edge and the cutting edge at the location of the central base parts of the hair refraction element and the cutting blade.

In order to achieve a larger retraction distance, the hair retraction element should preferably be spaced from the cutting edge of the associated cutter blade. This spacing increases the retraction distance present between the retraction edge of the hair retraction element and the cutting edge of the associated cutter blade and may for example be in the order of about 0.1 mm, or as specified for the particular application. The refraction distance may be set by choosing a suitable shape for the hair retraction elements that interacts with the V-shaped portions of the associated cutter blades to ensure the desired geometry. For the V-shaped hair retraction elements, this may be achieved by providing the central base part of the hair retraction element with a bending radius which is greater than a bending radius of the central base part of the associated cutter blade. For a cutter blade with a central base part having a bending radius of 0.2 mm, the central base part of the hair retraction element may be formed to have a bending radius of 0.3 mm. It is noted however that in such an arrangement, the retraction distance is highly dependent on the difference between these two bending radii, which may vary as a result of manufacturing tolerances.

In a preferred embodiment of the rotary cutter the angle enclosed by the leg parts of the cross-section of the hair-retraction element is smaller than the angle enclosed by the leg parts of the V-shaped portion of the cutting edge of the associated cutter blade. In this manner, contact between the cutter blade and the associated hair retraction element is limited to two points of contact, reducing friction and improving operation.

In a further preferred embodiment of the rotary cutter, a greater design freedom is achieved. To this end the cross-section of the hair retraction element has a truncated V-shape, for example a gutter shape, wherein the central base part of the cross-section is straight and has a length which determines a retraction distance present between the retraction edge of hair refraction element and the central base part of the cutting edge. As in the embodiment described before, the two leg parts of the cross-section preferably enclose an angle to each other that is smaller than the angle enclosed by the leg parts of the V-shaped portion of the cutter blade. An advantage of such a truncated V-shape is that, during manufacturing, bending takes place in two smaller bending zones where the two leg parts meet with the central base part. As long as the radius of these bending zones is sufficiently small (e.g. about 0.1 mm), the retraction distance is predominantly determined by the length of the central base part, so that manufacturing tolerances regarding the bending radius do not influence the retraction distance or only to a limited extend. In this manner manufacturing control over the geometric requirements is improved. Furthermore, the bending zones ensure point contacts between the hair retraction element and the associated cutter blade. Preferably, the hair retraction element has a bending zone between the central base part and each of the two leg parts of the cross-section, wherein each bending zone is in contact with a respective one of the leg parts of the V-shaped portion of the associated cutter blade in a position close to the central base part of the associated cutter blade.

The invention also relates to a cap forming an external cutting element for a shaving unit. The cap comprises an annular shaving track arranged concentrically about an axis for cooperation with cutting edges of a rotary cutter of the shaving unit, the shaving track being provided with hair-entry apertures that, seen in a direction of movement of the rotary cutter, have a front edge and a rear edge, wherein the front edges of the hair-entry apertures each have a V-shaped portion comprising a central base part interconnecting two associated leg parts mutually enclosing an angle, and wherein, in the direction of movement, each central base part of the V-shaped portions of the front edges is arranged in front of its associated leg parts, so that the V-shaped portions of the front edges point in the direction of movement.

As described above, the shearing angle that the front edge of the aperture makes with a cutter blade will determine the extent to which objects entering the aperture will be directed towards the central base part, which defines a central region where cutting primarily takes place.

In general, the apertures will be arranged around the complete circumference of the shaving track. It is however not excluded that only certain parts of the track are provided with such apertures while other regions are provided with different slots, alternative apertures or are left blank. Furthermore, while in general the apertures will be the same around the circumference, they may also vary in shape and angle. While a single track has been described, a plurality of concentric tracks may be provided, each interacting with respective cutter blades.

In a preferred form of the invention, the shaving track has an inner and an outer circumferential side surface and the apertures extend over one or both of the circumferential side surfaces. This extension allows hairs to more easily enter the apertures from one or both ends. It will be understood that although the V-shape of the front edges may extend over substantially the whole radial extent of the shaving track, this need not apply to the side surfaces. It will also be understood that in regions adjacent to the side surface the front edges may also have a different shape, in particular in non-cutting regions where engagement by the cutter blade does not occur. In this context, the shaving track may be defined to have a non-cutting region.

In a further embodiment of the invention, the outer surface of the track is domed or toroidal in shape. As discussed above, such a configuration is believed to be advantageous in improving shaving comfort and effectiveness by better conforming to the skin of a user while reducing doming effects.

In a yet further development of the invention, a thickness of the shaving track varies from a relatively thin portion at a position of the central base portion to relatively thicker portions on either side thereof corresponding to the leg parts. The thickness of the track at the points will generally be of primary importance in determining a closeness of the shave, and by reducing the thickness in this central region, significant improvements may be possible. Such thickness is of course relative and it will be understood that the overall thickness of the cap and track may be in the order of 70-150 microns. A thinner central region of the shaving track may have a thickness of 60 microns or less.

The invention also relates to a shaver comprising one or more shaving units according to any preceding claim and a drive mechanism to cause rotation of the cutter. Further items that are otherwise conventional will also be present including handles, switches, controls and power supply and are not further discussed here or considered relevant to the present invention as defined by the claims. Such shavers may be present in male or female models.

BRIEF DESCRIPTION OF THE DRAWINGS

The features and advantages of the invention will be appreciated upon reference to the following drawings of a number of exemplary embodiments, in which.

DETAILED DESCRIPTION OF EMBODIMENTS

Figure 1:
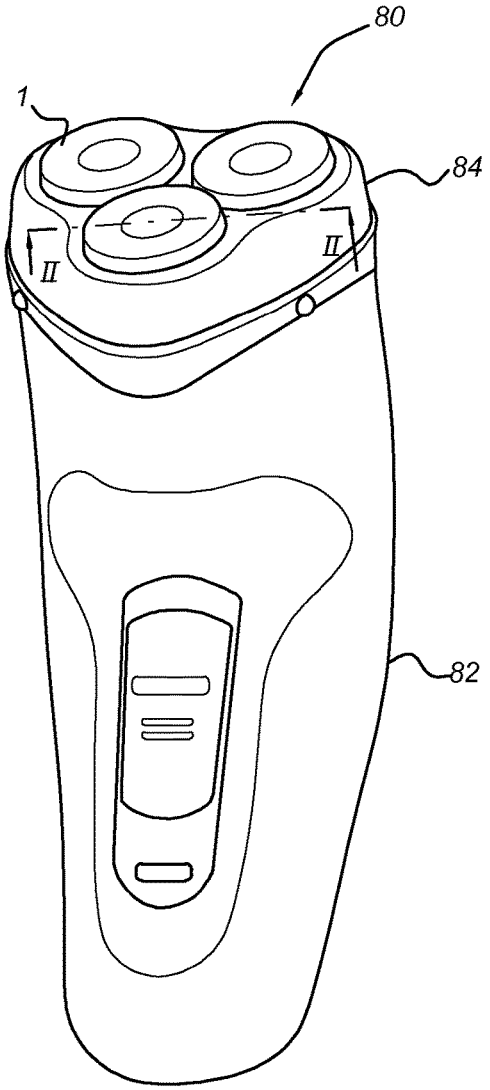
FIG. 1 shows a perspective view of a shaver according to the present invention.

FIG. 1 shows a perspective view of a shaver 80 according to the invention comprising a handle 82 and a head 84 on which are disposed three shaving units 1 as will further be described below.

Figure 2:
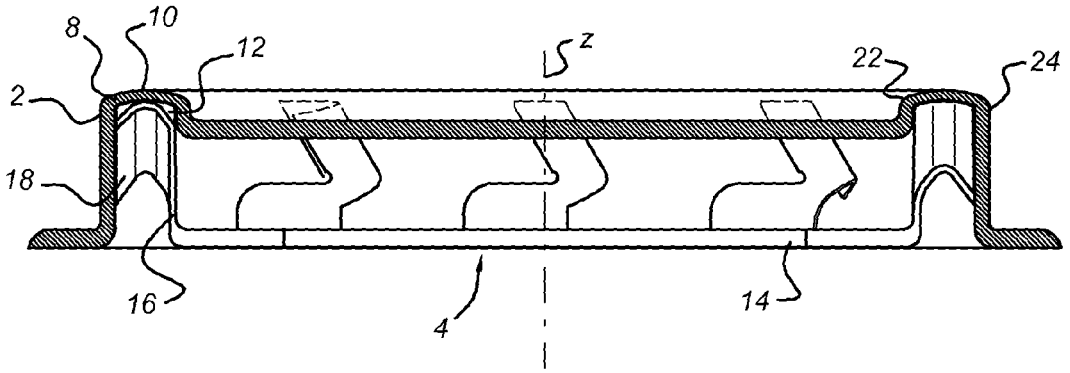
FIG. 2 shows a cross section along the line II-II of FIG. 1.

FIG. 2, shows a cross section through one of the shaving units 1 of FIG. 1, along line II-II. The shaving unit 1 comprises a cap 2 which forms the external cutting element of the shaving unit 1 and a cutter 4 which forms an internal cutting element. The cap 2 has an annular shaving track 8 with an outer surface 10 for engagement with the skin of a user. In this embodiment, the outer surface 10 is slightly domed or toroidal in shape. The skilled person will understand that the invention applies equally to shaving tracks that are flat or otherwise shaped. The shaving track 8 also has an inner circumferential side surface 22, an outer circumferential side surface 24 and an inner surface 12 which is also domed. The cutter 4 comprises a support member 14 having upstanding legs 16 arranged around its periphery. Each of the upstanding legs 16 carries a cutter blade 18 which engages the inner surface 12 of the shaving track 8. The cutter 4 rotates about the axis Z which is also concentric with the shaving track 8.

Figure 3:
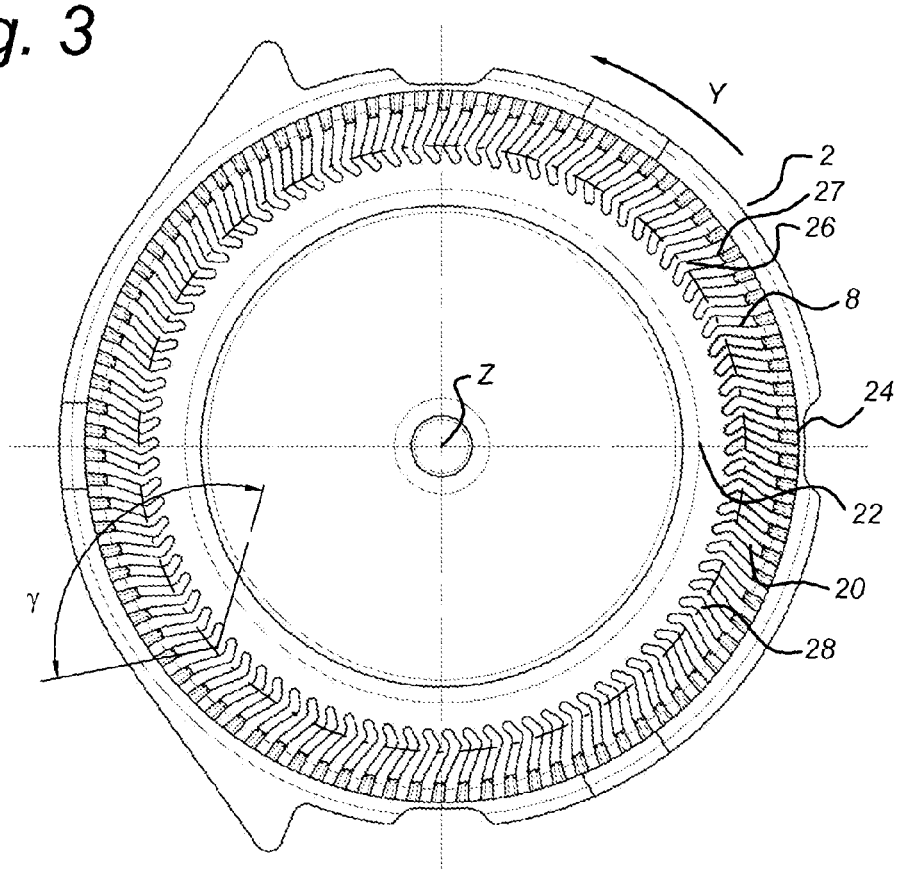
FIG. 3 shows a plan view of the cap of FIG. 2 in detail.

FIG. 3 shows in plan view the cap 2 of the shaving unit 1 of FIG. 2 in further detail. The shaving track 8 is provided with hair entry apertures 20 distributed throughout its circumference. The apertures 20 extend radially across the shaving track 8 from a position close to the inner circumferential side surface 22 to the outer circumferential side surface 24. The apertures 20 are arranged with front edges 44 having a V-shaped portion defined by a central base part 26 and leg parts 27, with the central base part 26 pointing in a direction Y of intended movement of the cutter blades 18 as they follow the shaving track 8. The central base parts 26 of the apertures 20 all lie on a circle i.e. they are each located at the same radial position with respect to the axis Z. This radial position defines a central region 28 at which cutting takes place, as will be further described below. FIG. 3 also shows the angle γ formed by the leg parts 27.

Figure 4:
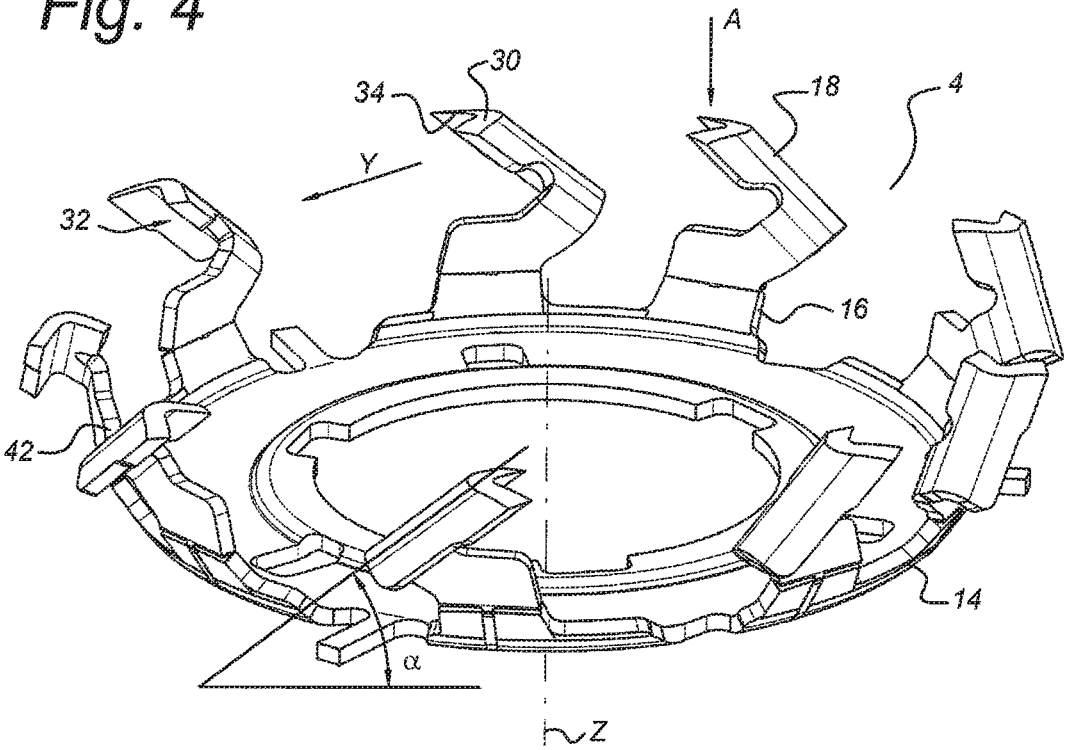
FIG. 4 shows a perspective view of a cutter according to the present invention.

FIG. 4 shows in perspective view the cutter 4 of FIG. 2 showing the support member 14, the upstanding legs 16 and the cutter blades 18. In this embodiment, nine cutter blades 18 are shown distributed uniformly around the periphery of the support member 14. It will be understood that different numbers of cutter blades may be provided as required.

Each cutter blade 18 has an upper face 30 for engagement with the inner surface 12 of the shaving track. In this embodiment, the upper face 30 is slightly domed with a curvature corresponding to the curvature of the inner surface 12. The cutter blade also has a front surface 32 oriented in the direction of movement Y of the cutter blade 18 during its rotation about the axis Z. The front surface 32 is concave in such a way that the front surface 32 and the upper face 30 intersect each other at a V-shaped cutting edge 34.

Figure 4A:
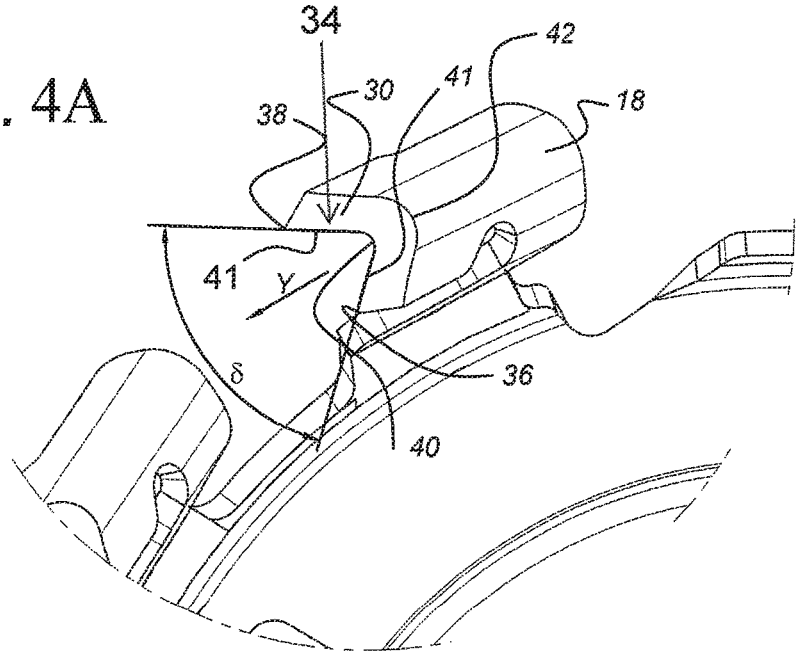
FIG. 4A shows a detail of a cutter blade of FIG. 4 viewed in the direction A.

FIG. 4A shows a detail view looking onto a cutter blade 18 of FIG. 4 in the direction A. The V-shape of the cutting edge 34 can be clearly seen extending from a radially inward tip 36 to a radially outward tip 38. A central base part 40 of the cutting edge between leg parts 41 defines a point of the V. This central base part 40 effectively trails both tips 36, 38 as the cutter blade 18 rotates in the direction Y. An angle δ is subtended by the leg parts 41.

As can also be seen from FIGS. 4 and 4A, the cutter 4 is formed from a single plate of metal in a stamping and cold forming procedure. The support member 14, the upstanding legs 16 and the cutter blades 18 all have a substantially constant material thickness. The V-shape of the cutting edge 34 is achieved by folding the cutter blade 18 material about a fold line 42. The fold lines 42, the cutter blades 18 and primarily the front surfaces 32 are all angled with respect to the direction of movement Y of the cutter blade by the cutter angle α. This is sometimes referred to as the wedge angle and in the presently illustrated embodiment is set at 45°.

Figure 5A:
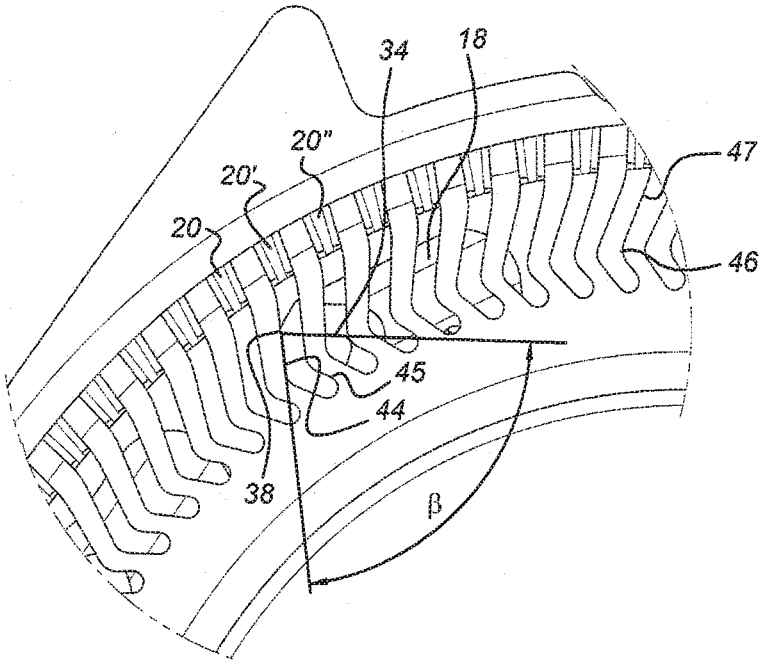
FIGS. 5A and 5B show detailed plan views of part of the cap of FIG. 3.
Figure 5B:
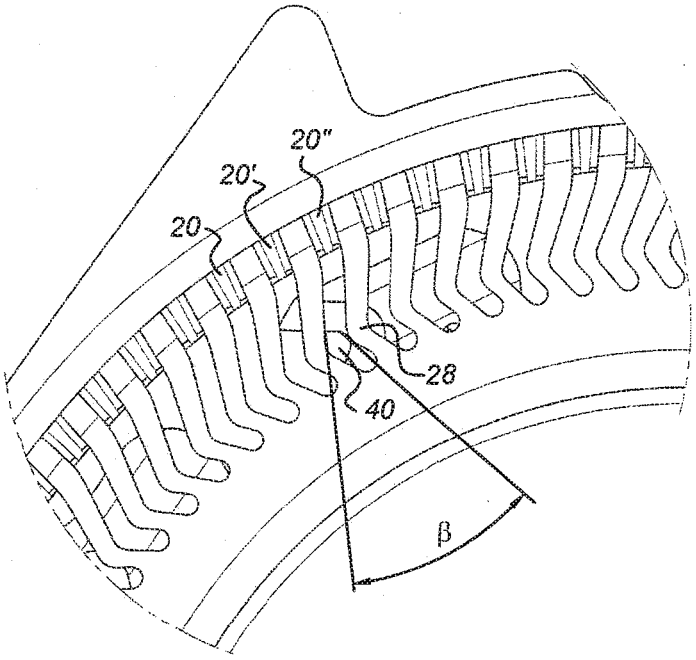

FIGS. 5A and 5B show detailed plan views of part of the cap 2 of FIG. 3 whereby a cutter blade 18 is visible through the apertures 20. In the position according to FIG. 5A, the outer tip 38 of the cutting edge 34 is just entering into contact with a front edge 44 of the aperture 20'. At this point a shearing angle β defined between the cutting edge 34 and the front edge 44 is relatively large. FIG. 5B shows the shearing angle β for the aperture 20" as the central base part 40 of the cutting edge 34 engages with the front edge 44 at the central region 28. At this point, the shearing angle β is relatively smaller.

In FIG. 5A, the rear edges 45 of the hair-entry apertures can also be seen, each having a V-shaped portion comprising a central base part 46, which interconnects two associated leg parts 47 of said V-shaped portion. FIGS. 5A and 5B also show that the angle γ (see FIG. 3) formed between the leg parts 27 of the apertures 20 is relatively wide or obtuse, compared with the angle δ (see FIG. 4A) subtended by the leg parts 41 of V-shaped cutting edge 34.

Figure 6A:
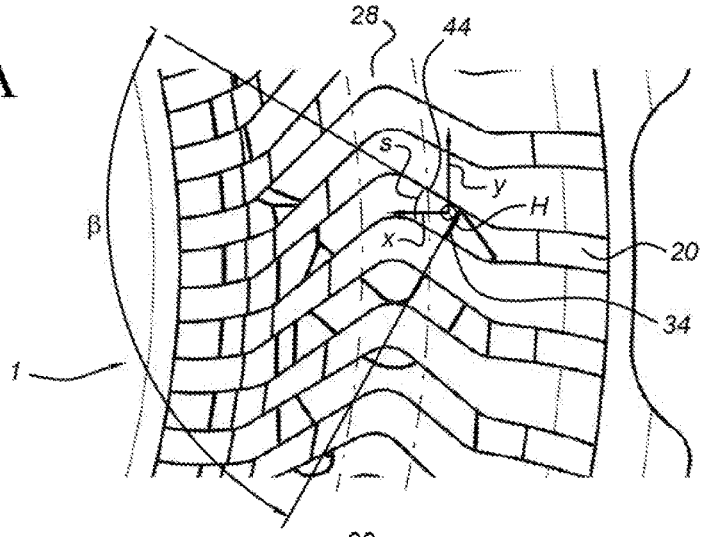
FIGS. 6A to C show detailed plan views of part of the shaving unit of the invention in operation.
Figure 6B:
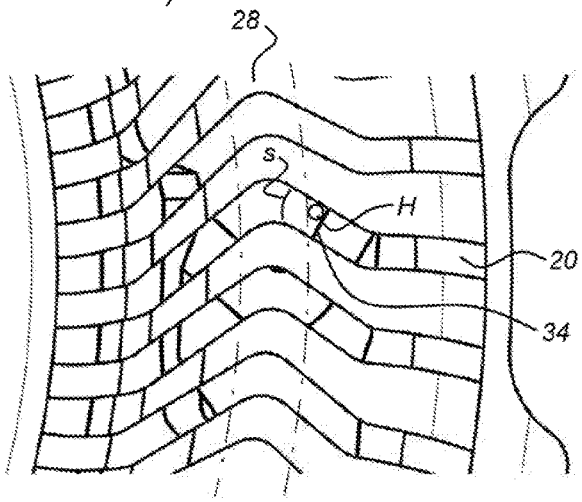
Figure 6C:
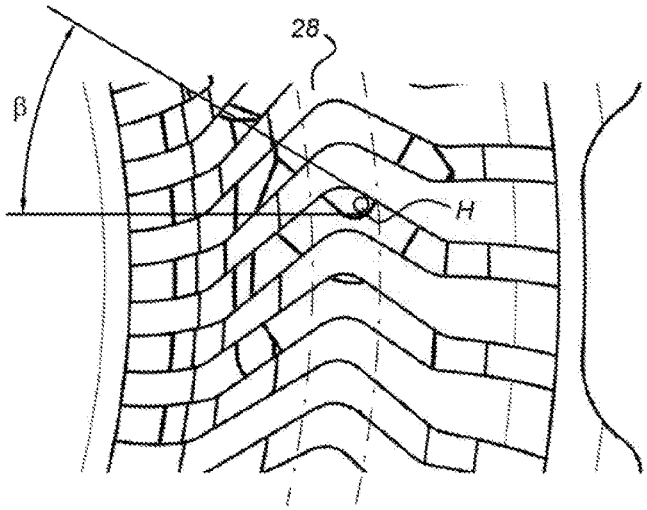

FIGS. 6A to 6C illustrate a portion of a shaving unit 1 according to the invention during operation in cutting of a hair H. It will be understood that this operation is the manner in which the device is believed to operate. Nevertheless, the present invention is in no way limited to such principles of operation and is defined according to the features of the claims. In the position of FIG. 6A, which represents the start of a cycle, the cutting edge 34 has engaged the hair H which has entered into aperture 20. The cutting edge 34 has also engaged skin S which has protruded into the aperture 20 by an effect known as doming. The large shearing angle β at this position deflects obstacles away from the path of the cutter blade 18. This is due to the impact between the cutting edge 34 and an obstacle being at an angle, generating forces in both the direction of motion Y and radially X, towards the centre of the V. During the impact, the points of contact between the skin S, the cutting edge 34 and the front edge 44 create opposing friction points, whilst the force that continues to be applied by the moving cutting edge 34 generates tension within the trapped skin fold. In a conventional straight slot arrangement, where a shearing angle is constant and small, the friction forces generated are often larger than the tensile stress pulling the skin away from the internal cutter, resulting in skin being cut between the engaging edges of the cutter and cap. However in the present configuration according to FIG. 6A, due to the X and Y components of forces generated, the tensile force in the X direction reduces friction in the Y direction. The net force generated stretches the skin S towards the central region 28 (FIG. 6B), overcoming the friction in the Y direction and releasing the skin fold. As the tension is released, the skin reacts in the opposite direction, retracting radially outwards from the central region 28, deforming under the cutter blade 18 and out of the aperture 20. This process continues as the point of the V-shaped cutting edge 34 and the central base part of the aperture 20 pass each other (FIG. 6C), constantly pulling skin away from the central region 28 and stretching the skin taught.

In contrast, the hair H does not display the same behavior and does not follow the skin S due to the different geometry of the hair. In particular, the hair is a relatively long, rigid body that protrudes completely through the hair catching aperture. It also has a relatively deep anchoring position at the hair follicle, which creates a point of rotation considerably lower than the surface of the skin. As the hair H comes into contact with the cutting edge 34, the hair H is pushed towards the front edge 44 of the aperture 20 and dragged along the leg part 27 (FIG. 6B), pivoting around its anchor point within the skin, until it is trapped at the central base part 26 in the central region 28 (FIG. 6C). At the end of the cycle the resulting effect is that skin S has been pulled taught and out of the shaving area, whilst the hair H has been manipulated to the central region 28 and trapped. As the central base part 40 of the V-shaped cutting edge 34 and the central base part 26 of the front edge 44 of the aperture 20 pass each other, the shearing angle β is significantly reduced, increasing the opposing friction forces generated and severing the hair H between the cutting edge 34 and the front edge 44.

Figure 7:
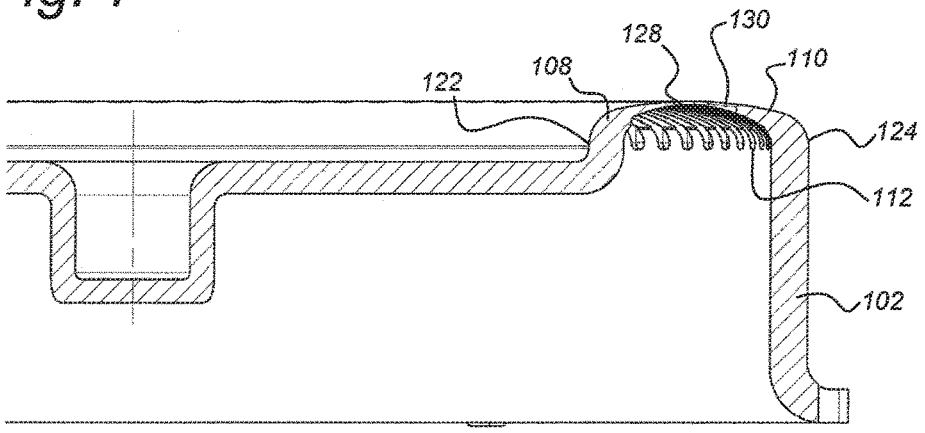
FIG. 7 shows a partial cross-section through a cap according to a second embodiment of the invention.
Figure 7A:
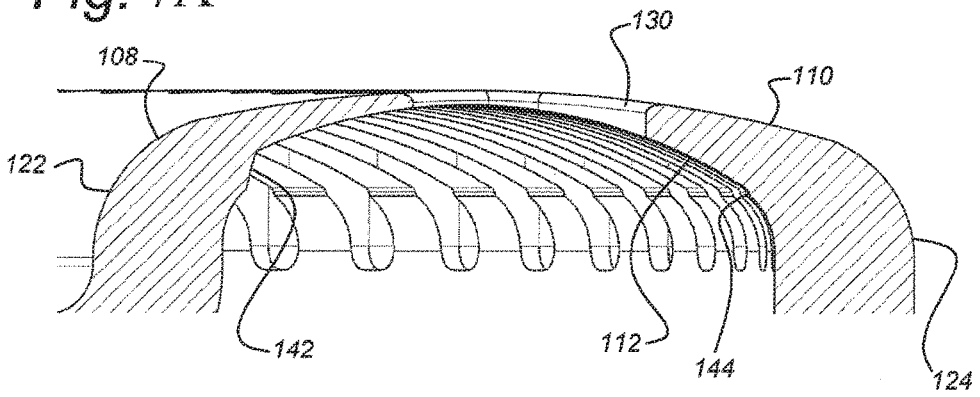
FIG. 7A shows a detail of the shaving track of FIG. 7.

FIG. 7 shows a partial cross-section of an alternative embodiment of a cap 102 according to the invention in which the annular shaving track 108 has an outer surface 110 which is curved differently to the inner surface 112. As can better be seen in the detailed view of FIG. 7A, this results in a variation in thickness of the shaving track 108 from the circumferential side surfaces 122, 124 to the mid-region 128. The axial extent of the apertures 120 is therefore also relatively greater closer to the circumferential side surfaces 122, 124 than in the mid-region 128. In the illustrated embodiment, a cap thickness in the central region is less than 60 micron. In this manner, increased shaving closeness may be achieved in the mid region 128 where cutting takes place, without increased risk of skin entry, due to the fact that skin doming in this region is reduced by the mechanism described above. As can also be noted in FIG. 7A, the inner surface 112 of the shaving track 108 has a non circular profile with inner and outer stepped regions 142, 144 corresponding to the inward tip 36 and the outward tip 38 of a mating cutter blade 18.

Figure 8:
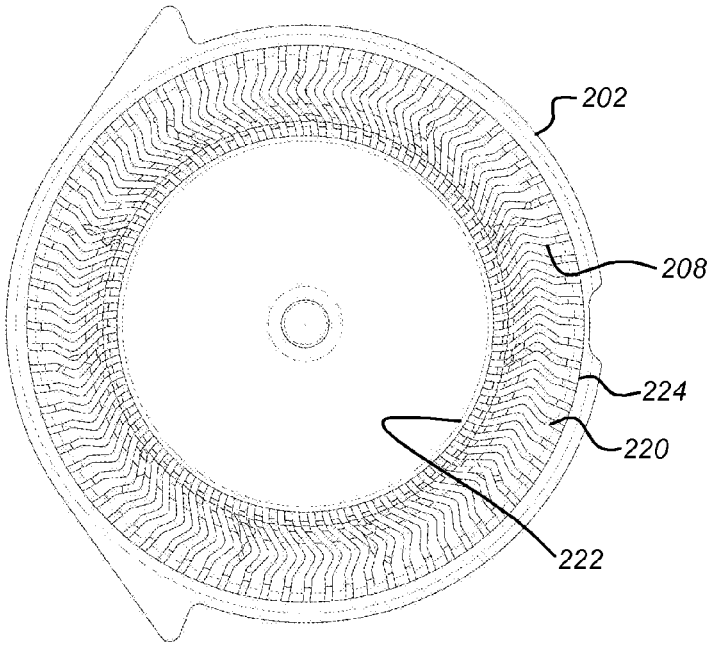
FIG. 8 shows a cap according to a third embodiment of the invention.

FIG. 8 shows a plan view of third embodiment of a cap 202 according to the invention, in which the shaving track 208 comprises apertures 220 that extend from the inner circumferential side surface 222 to the outer circumferential side surface 224. The apertures 220 thus are open ended at both extremities and can receive hairs during shaving motion of the shaver 80 in either direction.

Figure 9:
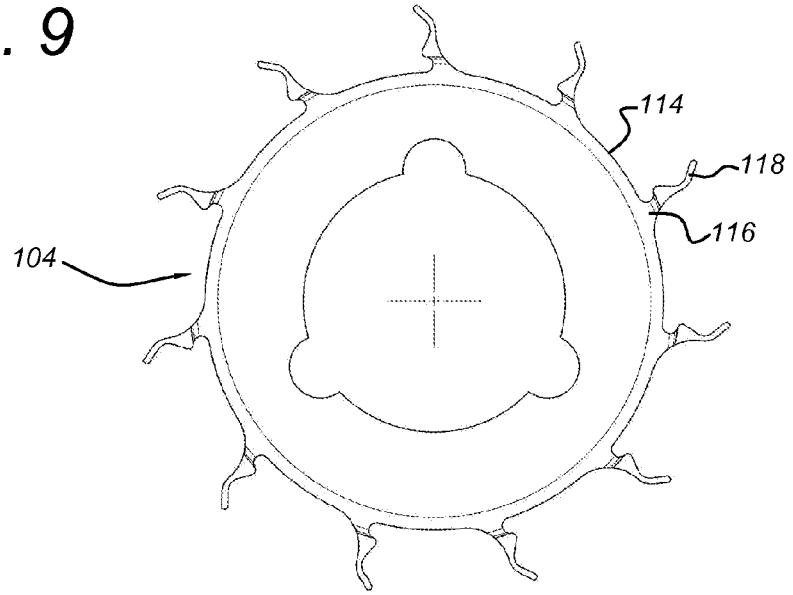
FIG. 9 shows a plan view of an alternative cutter according to the invention.

FIG. 9 shows in plan view an alternative embodiment of a cutter 104 according to the invention, having cutter blades 118 angled at a shaving angle of 90°. The cutter blades 118 are integrally formed with an annular support member 114 having upstanding legs 116 extending radially outwards from the support member 114.

Figure 10:
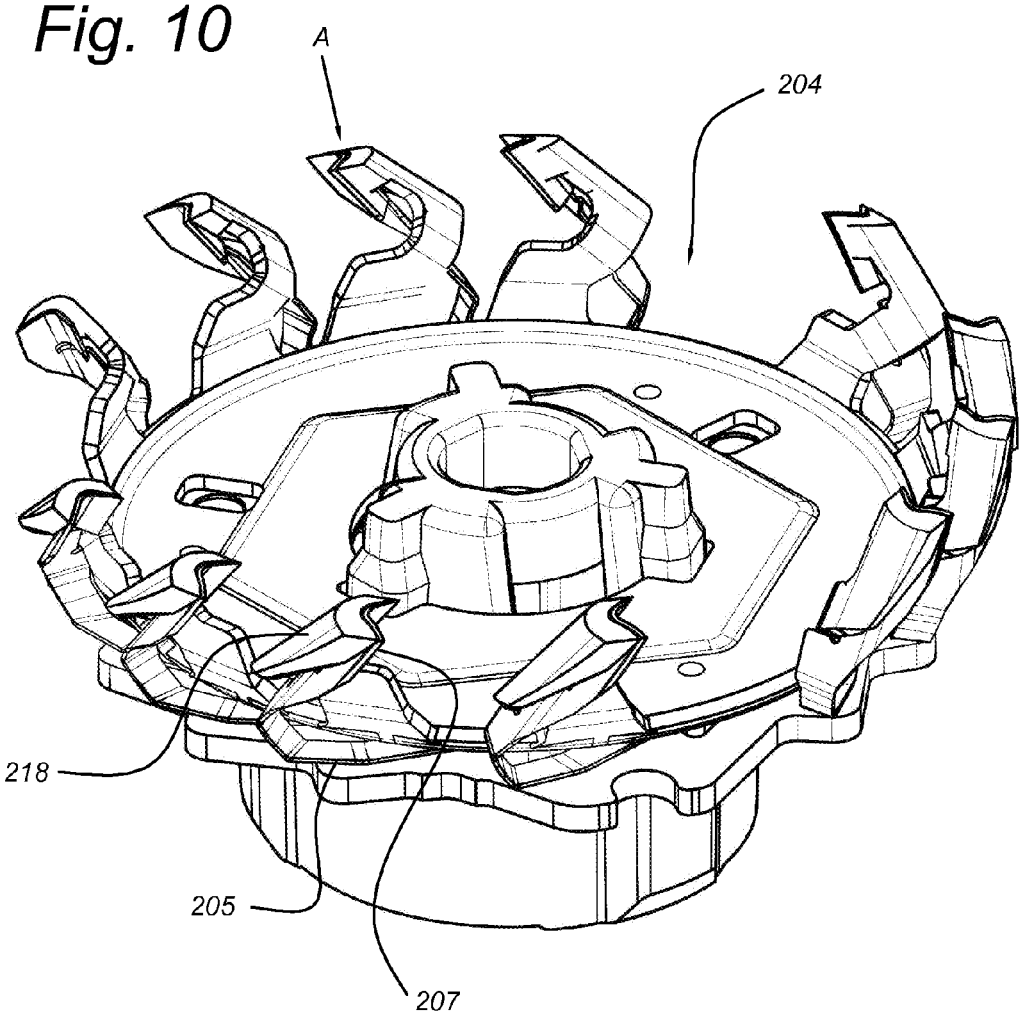
FIG. 10 shows a perspective view of another alternative cutter including a retraction mechanism.

FIG. 10 shows in perspective view a third embodiment of a cutter 204 according to the invention which is provided with a retraction mechanism 205. The retraction mechanism 205 comprises hair retraction elements 207 arranged ahead of each of the cutter blades 218 in the direction of movement of the cutter 204. The hair retraction elements 207 are resiliently mounted on the support member of the cutter 204 and are arranged to snag hairs during operation and pull them further through the apertures in the cap whereby the cutter blade 218 can cut them still shorter. Further details about the operation of hair retraction mechanisms are to be found in EP1212176 A1 and WO2010/113068, the contents of which are hereby incorporated by reference in their entirety.

Figure 11:
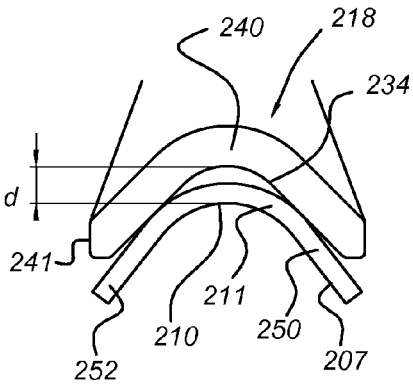
FIG. 11 shows a detail of a cutter blade of the cutter of FIG. 10 taken in direction A.

FIG. 11 shows a detail of one of the cutter blades 218 of the cutter 204 of FIG. 10 taken in direction A, showing the respective geometries of the cutting edge 234 and the hair retraction element 207. The hair retraction element 207 has a retraction edge 210 and has a V-shaped cross-section extending perpendicular to the axis of rotation of the cutter 204. The V-shaped cross-section includes a central base part 211 having a relatively large bending radius and interconnecting two associated leg parts 250, 252, which mutually enclose an angle. At the location of the central base part 211, the cutting edge 234 of the cutter blade 218 and the hair retraction element 207 are spaced from each other. This spacing increases a retraction distance d present between the cutting edge 234 and the retraction edge 210, which determines a pulling distance over which the hair retraction element 207 pulls the hairs out of the skin before being cut by the cutting edge 234. In this embodiment, the bending radius of the central base part 211 of the hair refraction element 207 is larger than the bending radius of the central base part 240 of the cutting edge 234, and the retraction distance d is determined by a difference between the bending radii of the central base part 211 of the hair retraction element 207 and the central base part 240 of the cutting edge 234.

Figure 12:
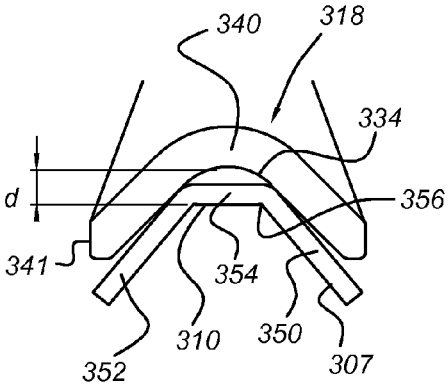
FIG. 12 shows a detail similar to FIG. 11 of a cutter blade and refraction mechanism according to an alternative embodiment.

FIG. 12 shows a detail similar to FIG. 11 of a cutter blade 318 of a cutter according to an alternative embodiment. According to this embodiment, the cross-section of the hair retraction element 307 has a truncated V-shape or gutter shape. The cross-section of the hair retraction element 307 includes a straight central base part 354 located between two leg parts 350, 352. The two leg parts 350, 352 enclose an angle that is smaller than the angle enclosed by the leg parts 341 of the cutter blade 318. The leg parts 350, 352 and central base part 354 meet at bending zones 356 having a relatively small radius of curvature, for example about around 0.1 mm. As can be seen, in this embodiment the retraction distance d present between the cutting edge 334 of the cutter blade 318 and the retraction edge 310 of the hair retraction element 307 is determined primarily by a length of the central base part 354 between the bending zones 356 and by the bending radius of the central base part 340 of the cutter blade 318. In this embodiment, manufacturing tolerances regarding the bending radius of the bending zones 356 do not influence the refraction distance d or only to a limited extend. In this manner, because manufacturing tolerances regarding the length of the central base part 354 can be controlled relatively easily, manufacturing control over the geometric requirements for forming an effective retraction mechanism is improved. As further shown in FIG. 12, the hair retraction element 307 is in contact with the cutter blade 318 by the two bending zones 356. The bending zones 356 each contact a respective one of the leg parts 341 of the V-shaped portion of the cutter blade 318 in a position close to the central base part 340 of the cutter blade 318.

The invention has thus been exemplified by the embodiments discussed above. It will be recognized that these embodiments are susceptible to various modifications and alternative forms well known to those of skill in the art. In particular, the shapes of the slots and blades may be distinct from the schematically illustrated designs.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. A shaving unit comprising:

a rotary cutter including cutter blades having a cutting edge, the rotary cutter being configured to rotate about an axis in a direction of movement; and a cap having a shaving track arranged concentrically about the axis for cooperation with the cutter blades, the shaving track being provided with hair-entry apertures that, seen in the direction of movement, have a front edge and a rear edge, wherein the front edge of the hair-entry apertures and the cutting edge of the cutter blades each have a V-shaped portion comprising a central base part interconnecting two associated leg parts mutually enclosing an angle, wherein, in the direction of movement, the central base part of the V-shaped portion of the front edge is arranged in front of the two associated leg parts, of the front edge the V-shaped portion of the front edge pointing in the direction of movement, and wherein, in the direction of movement, the central base part of the V-shaped portion of the cutting edge is arranged behind the two associated leg parts, of the cutting edge the V-shaped portion of the cutting edge pointing in a direction opposite to the direction of movement.

2. The shaving unit according to claim 1, wherein the central base part of the V-shaped portion of said front edge and the central base part of the V-shaped portion of the cutting edges edge are arranged at a single radial distance from the axis.

3. The shaving unit according to claim 1, wherein the central base part of at least one of the front edge and the cutting edge has a curved shape.

4. The shaving unit according to claim 1, wherein the angle enclosed by the two associated leg parts of the V-shaped portion of the front edge is larger than the angle enclosed by the two associated leg parts of the V-shaped portion of the cutting edge.

5. The shaving unit according to claim 1, wherein the rear edge has a V-shaped portion comprising a central base part, which interconnects two associated leg parts of the rear edge mutually enclosing an angle and which, in the direction of movement, is arranged in front of the two associated leg parts of the rear edge, so that the V-shaped portion of the rear edge points in the direction of movement.

6. The shaving unit according to claim 1, wherein the hair-entry apertures extend radially inwards beyond the cutter blades to an inner circumferential side surface of the shaving track.

7. A shaver comprising at least one shaving unit according to claim 1, and further comprising a drive mechanism to cause rotation of the rotary cutter.

8. A rotary cutter for a shaving unit comprising: a support member having an axis of rotation, said support member carrying a plurality of upstanding legs each terminating in a cutter blade having a cutting edge, each cutter blade having a direction of movement during rotation of the rotary cutter about the axis of rotation, wherein the cutting edge has a V-shaped portion comprising a central base part interconnecting two associated leg parts mutually enclosing an angle, wherein, in the direction of movement, the central base part of the V-shaped portion is arranged behind the two associated leg parts, and wherein the V-shaped portion of the cutting edge points in a direction opposite to the direction of movement.

9. The rotary cutter according to claim 8, wherein the angle is between 60° and 120°.

10. The rotary cutter according to claim 8, wherein the cutter blade has a front surface oriented in the direction of movement and terminating in the cutting edge, and wherein the front surface is angled with respect to the direction of movement by a cutter angle being one of between 35° and 70° and between 40° and 50°.

11. The rotary cutter according to claim 8, wherein the V-shaped portion extends from a radially inward tip to a radially outward tip of the cutting edge.

12. The rotary cutter according to claim 11, wherein the V-shaped portion is substantially symmetrical about the central base part of the cutting edge.

13. The rotary cutter according to claim 8, further comprising a retraction mechanism having a hair retraction element associated with the cutter blade and arranged ahead of the cutter blade in the direction of movement and nested within the V-shaped portion of the cutter blade, and wherein the hair retraction element comprises a retraction edge and a V-shaped cross-section extending perpendicular to the axis of rotation, said V-shaped cross-section having a central base part interconnecting two associated leg parts mutually enclosing an angle.

14. The rotary cutter according to claim 13, wherein the angle enclosed by the two associated leg parts of the V-shaped cross-section of the hair retraction element is smaller than the angle enclosed by the two associated leg parts of the V-shaped portion of the cutting edge of the cutter blade.

15. The rotary cutter according to claim 8, further comprising a retraction mechanism having a hair retraction element associated with the cutter blade and arranged ahead of the cutter blade in the direction of movement and nested within the V-shaped portion of the cutter blade wherein the hair retraction element comprises a retraction edge and a truncated V-shaped cross-section extending perpendicular to the axis of rotation, said truncated V-shaped cross-section having a central base part interconnecting two associated leg parts mutually enclosing an angle, and wherein the central base part of the truncated V-shaped cross-section is straight and has a length which determines a retraction distance present between the retraction edge of the hair retraction element and the central base part of the cutting edge.

16. The rotary cutter according to claim 15, wherein the hair retraction element has a bending zone between the central base part and each of the two associated leg parts of the truncated V-shaped cross-section, and wherein the bending zone is in contact with a respective one of the two associated leg parts of the V-shaped portion of the cutter blade in a position close to the central base part of the cutter blade.

17. A shaving unit comprising a cap and a rotary cutter rotatably arranged relative to the cap, wherein the rotary cutter is a rotary cutter according to claim 8.

18. A shaving unit comprising:

a rotary cutter comprising cutter blades having a cutting edge, the rotary cutter being configured to rotate about an axis in a direction of movement; and a cap having a shaving track arranged concentrically about the axis for cooperation with the cutter blades, the shaving track being provided with hair-entry apertures that, seen in the direction of movement, have a front edge and a rear edge, wherein the front edge of the hair-entry apertures and the cutting edge of the cutter blades each have a V-shaped portion comprising a central base part interconnecting two associated leg parts mutually enclosing an angle, and wherein, in the direction of movement, the central base part of the V-shaped portion of the cutting edge is arranged behind the two associated leg parts, of the cutting edge wherein the V-shaped portion of the cutting edge points in a direction opposite to the direction of movement.

19. The shaving unit according to claim 18, wherein, in the direction of movement, the central base part of the V-shaped portion of the front edge is arranged in front of the two associated leg parts, of the front edge wherein the V-shaped portion of the front edge points in the direction of movement.

* * * * *